US005142980A

United States Patent [19]

Böttger et al.

[11] Patent Number: 5,142,980

[45] Date of Patent: Sep. 1, 1992

[54] PNEUMATIC CONTROLLER FOR A PRINTING MACHINE

[75] Inventors: Johannes Böttger, Weinböhla; Falk Buschmann, Coswig, both of Fed. Rep. of Germany

[73] Assignee: KBA-Planeta AG, Radebeul, Fed. Rep. of Germany

[21] Appl. No.: 686,709

[22] Filed: Apr. 17, 1991

[30] Foreign Application Priority Data

Apr. 18, 1990 [DE] Fed. Rep. of Germany ..... 3398253

[51] Int. Cl.[5] ..... B41F 13/24

[52] U.S. Cl. ..... 101/233; 101/192; 101/247; 101/234

[58] Field of Search ..... 101/233, 232, 247, 234, 101/192; 73/202.5; 269/21; 340/674, 675

[56] References Cited

U.S. PATENT DOCUMENTS

| | | | |
|---|---|---|---|
| 2,926,684 | 3/1960 | Replogle | 73/202.5 |
| 3,425,277 | 2/1969 | Adams | 73/202.5 |
| 4,246,775 | 1/1981 | Stultz | 73/159 |
| 4,515,014 | 5/1985 | Sumal | 73/202.5 |
| 4,648,270 | 3/1987 | Johnson et al. | 73/202.5 |
| 4,916,948 | 4/1990 | Inada et al. | 73/202.5 |

FOREIGN PATENT DOCUMENTS

| | | | |
|---|---|---|---|
| 1536448 | 5/1966 | Fed. Rep. of Germany | 101/247 |
| 1320282 | 6/1973 | United Kingdom | 101/232 |

*Primary Examiner*—Edgar S. Burr
*Assistant Examiner*—Anthony Nguyen
*Attorney, Agent, or Firm*—Michael J. Striker

[57] ABSTRACT

The pneumatic controller for detecting the presence or absence of sheets fed through a press machine includes a suction system having a suction duct in a sheet feed cylinder of the press machine and a vacuum pump connected to the suction duct, the suction duct opening onto a surface of the sheet feed cylinder on which one of the sheets contacts at least partially obstructing an air flow through the suction duct during normal press operation. To rapidly detect a sudden increase in the air flow through the suction duct caused by a missing sheet, the pneumatic controller is provided with a flow sensor (1) in the suction duct having a hot wire (16) and a surrounding protective jacket (15), and an analyzing circuit (2) connected to the flow sensor. The analyzing circuit (2) detects the temporary cooling of the hot wire (16) caused by the increase in the air flow rate and the analyzing circuit (2) detects the change of resistance of the wire and generates and amplified voltage output signal.

7 Claims, 4 Drawing Sheets

PNEUMATIC CONTROLLER FOR A PRINTING MACHINE

BACKGROUND OF THE INVENTION

The present invention relates to a pneumatic controller in a printing machine for detection of sheets held on a sheet feed cylinder and, more particularly, to a pneumatic controller which acts to idle or halt the printing machine, when sheets are not present on the sheet guide cylinder.

This type of device is used particularly in printing machines, in which the sheet for the first form and second working is turned according to the principle of sheet rear edge turning for control, if the sheet is on the sheet feed cylinder.

According to DD-PS 212 024 the control occurs by sensing and transmitting devices attached to opposing printing machine walls. The sensing and transmitting devices can communicate using ordinary light, laser light or ultrasonic waves. The detecting beam can be inclined at from 10 to 40 degrees to the cylinder axis. The sheet feed runs, when the detection beam extending from the transmitting device passes through the correctly fed sheet in the inclined direction and continues with reduced intensity to the sensing device, so that no signal is generated in the sensing device and subsequent commands in connected devices are not generated. When a sheet is not properly in place during the sheet feed operations and the detection beam does not pass through the sheet, the full intensity of the unattenuated detection beam impinges on the sensing device and the sensing device generates a output signal activating additional commands, such as printing machine halt and reduction of machine speed or a machine halt, in controlling mechanisms.

A disadvantage of the controller described in the above paragraph is that its performance depends on the paper characteristics such as its transparency, surface properties and/or its weight and this requires time-consuming adjustments. An additional disadvantage is that the controller is only reliable up to a certain minimum size. With smaller sizes the desired switching off of the sensing device may no longer occur and the controller functions incorrectly. An additional disadvantage is the high sensitivity of the device to dirt and dust.

A sheet responsive device is also described in DE-AS 26 21 289, in which the sheet located on the sheet turning drum is detected by a row of suction devices at its rear edge. With only partial covering of the suction devices arranged in a row in the device, the flow of air is interrupted and a provided pressure gauge and connected controlling mechanisms cause the idling or the halt of the printing machine.

The controller described in the paragraph immediately above has the disadvantage that the control depends on the measurement of the low pressure in the air flow at the suction devices located on the sheet turning device. With optimum design of the entire pneumatic system for control of the suction devices, the low pressure in the suction air guides or ducts, changes only slightly during the air flow through them and the control is very sluggish. Since, above all with a high sheet feed rate only a short time is available for sheet control, this device does can make errors, particularly at high sheet feed rates.

SUMMARY OF THE INVENTION

It is an object of the present invention to provide a pneumatic controller in a printing machine, which is simple in structure and is useful for all printing material and sheet sizes.

It is also an object of the invention to provide a pneumatic controller in a printing machine, which performs a rapid, reliable error-free sheet feeding at the highest speeds of the printing machine.

According to the invention, the pneumatic controller includes an anemometer comprising a flow sensor and an analyzing circuit, the flow sensor being electrically connected to analyzing circuit, advantageously by an analog signal conducting means, so that the analyzing circuit can receive an electrical signal from the flow sensor.

Advantageously, the flow sensor is located in the suction duct of a suction device. The flow sensor advantageously comprises a hot wire and a protective jacket. The hot wire is electrically connected by the analog signal conducting means with the evaluating circuit. The analog signal conducting means is, of course, in the simplest case a pair of wires.

The pneumatic controller is simple in structure and function. It is operable with reduced expense. It requires scarcely any additional control and measuring devices in the rotating parts of the press and can be used with almost all press materials.

Since air flow is used for control, the pneumatic controller of the invention reacts rapidly and also at the highest rotary speeds of the printing machine. It has proven very advantageous that the volume flow in the suction duct of the suction device in the sheet feed cylinder can be detected and is analyzed by a suitable analyzing circuit. When the sheet feed is proper only a very slight air flow rate is detected in the suction duct, since the pneumatic sheet guide elements are closed by the sheets and, as a result, the air flow is significantly hindered. In case of faulty operation in which a sheet is lost or lies pushed into the suction members, then air can flow unimpeded in the suction duct and, as a result, also is detected and analyzed by the analyzing circuit. In that case, the controller can cause a machine halt.

The control by the controller of the invention using the volume flow in the air suction duct has, in contrast to the prior art device which utilizes the low pressure in the same locations, thus a significant advantage, because it depends directly on the existence of an open condition of the suction device, as opposed to control by low pressure, which includes low pressure generated anywhere in the entire pneumatic system. Consequently, a large change in measured signal results in the faulty operation case with the controller according to the invention. Furthermore, this large change of signal is rapidly detected by the sensing device of the invention. In analogy to the case of an electric circuit, the low pressure can be compared with the voltage of the supply and the flow rate measurement can be compared to the electric current. In connecting the supply the current changes dramatically and immediately and the voltage of the supply only slightly.

Furthermore it is beneficial that in vacuum the mobility of the gas molecules is larger, and/or the friction is reduced, so that short characteristic times arise for the volume flow.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE INVENTION

Figure 1:
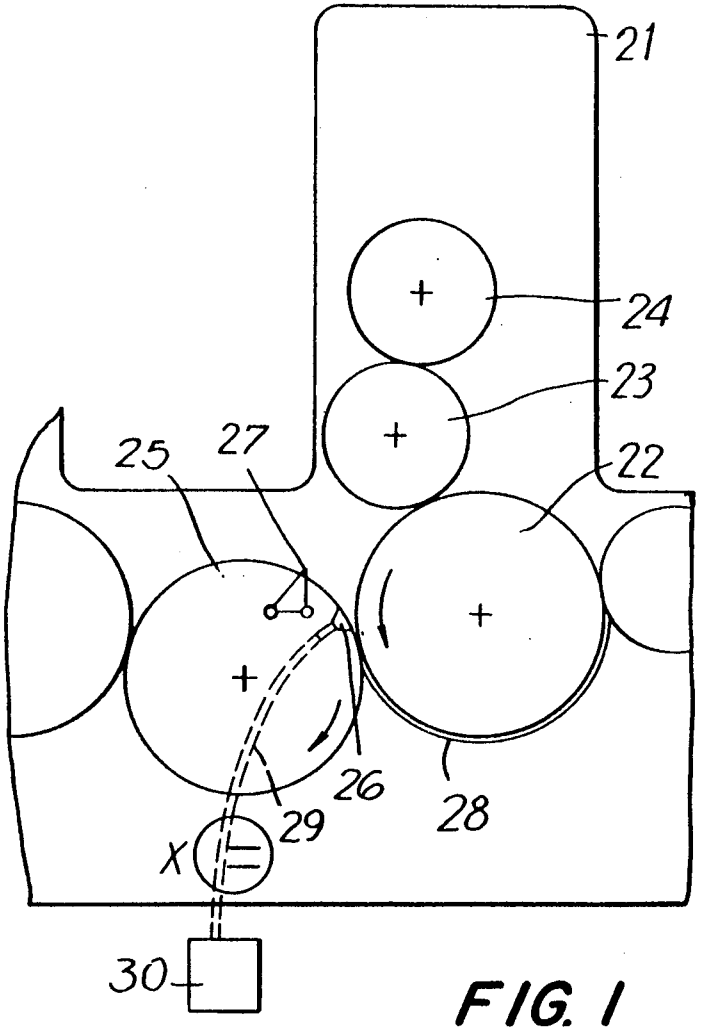
FIG. 1 is a schematic cross sectional view through a portion of a printing machine with a sheet feed cylinder having a pneumatic controller according to the invention connected with a suction device in the sheet feed cylinder.
Figure 5:
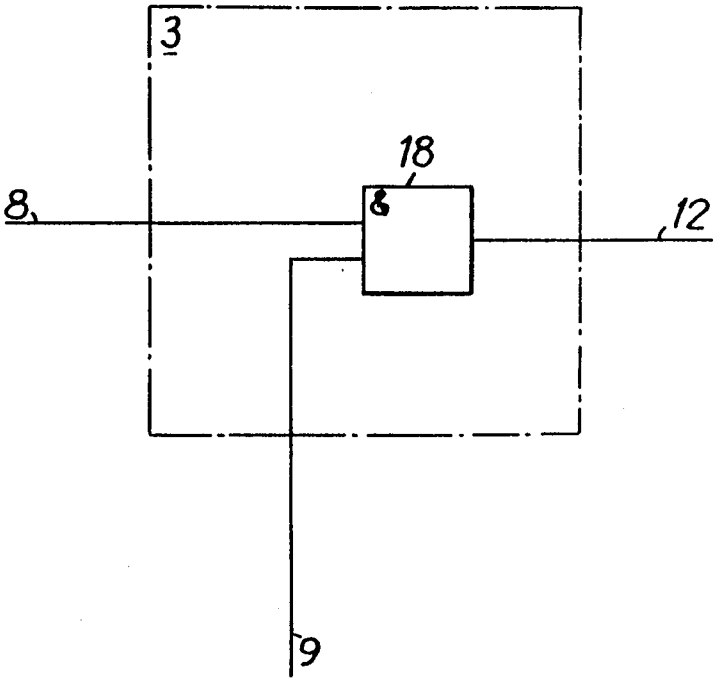
FIG. 5 is a block diagram of a logic masking circuit which connects to the analyzing circuit.

FIG. 1 is a schematic drawing showing a portion of the printing machine 21 in which the pneumatic controller is installed. The printing machine includes a press cylinder 22, a rubber cylinder 23 and plate cylinder 24. The sheet feed cylinder 25 formed as a turning drum is arranged downstream of the press cylinder 22.

The sheet feed cylinder 25 is known and described previously, for example in Patent DD-PS 54 703, and is provided with a suction system 26 and with a gripper system 27. The suction system 26 is connected with a source of low pressure 30, particularly a vacuum compressor, by an unshown control valve, which is located inside the sheet feed cylinder 25 and by a tubular suction duct 29.

Figure 2:
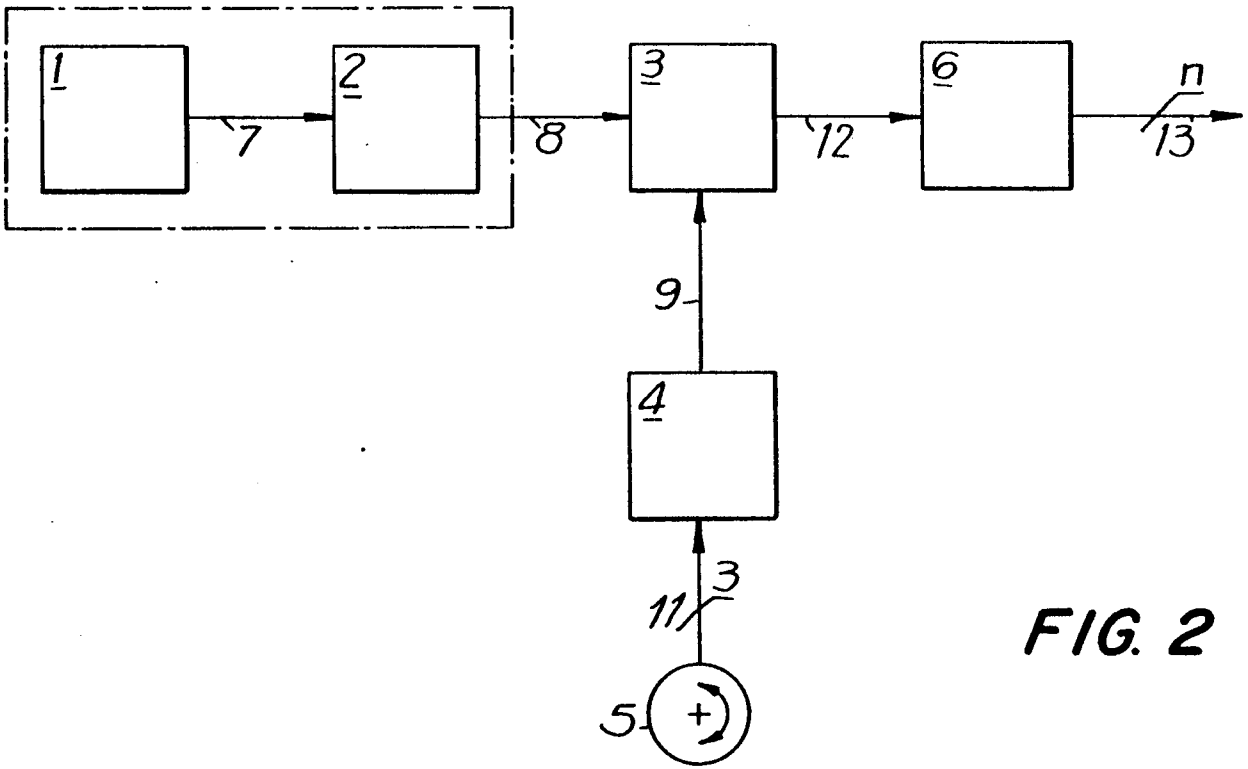
FIG. 2 is a block diagram of a pneumatic controller according to the invention indicated in the circle labelled X in FIG. 1.

In the suction duct 29 the control activates a first form and second working or printing by a pneumatic-electrical operating means, if the sheet 28 contacts the suction system 26. The control mechanism has the following structure: In the suction duct 29 (see circle x in FIG. 1) a flow sensor 1 is located. The flow sensor 1 (see FIG. 2), which comprises a hot wire 16 and a protective jacket 15, is connected with analyzing circuit 2 by the analog signal conducting means 7, whose dual signal acts on the output signal conductor 8 on a masking circuit 3. The anemometer 1,7 and 2 is formed by the flow sensor 1, the analyzing circuit 2 and the analog signal conducting means 7. Flowing air in the suction duct 29 contacts the hot wire 16 directly, because the protective jacket 15 is partially open.

A rotation angle transmitter 5, advantageously formed as a rotation increment detector, is coupled by a rotation angle bus 11 to a central pulse generator 4, whose output also acts on the masking circuit 3. The output of the masking circuit 3 is an operation error signal, which is transmitted over an electrical connecting line 12, which is connected with the inputs of an associated control system 6. This control system 6 generates a process control signal, which is transmitted over another connecting line 13. The control signal acts on the digital control members of the press machine, which are not shown in detail here, to perform the desired actions.

Figure 3:
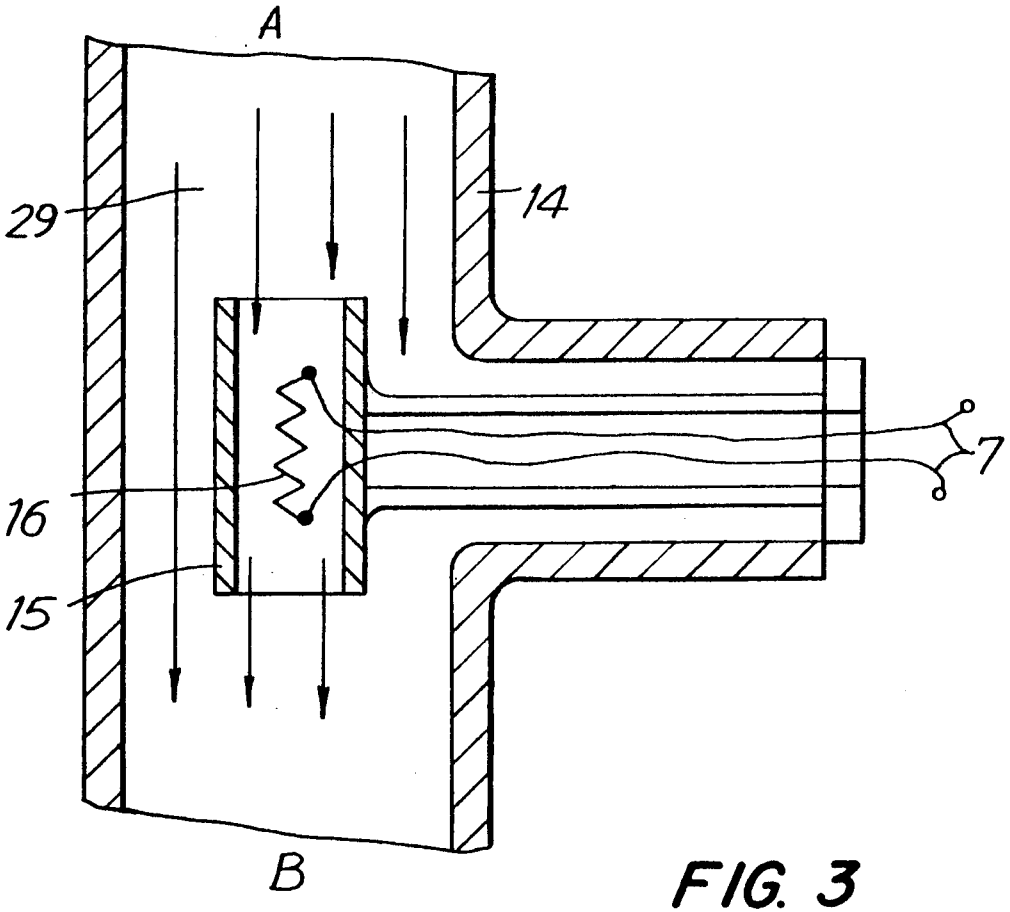
FIG. 3 is a cross sectional view through a suction duct shown at X in FIG. 1 and a sensing device of the pneumatic controller according to the invention.

The flow sensor 1 comprises a hot wire 16 and a protective jacket 15 surrounding the hot wire 16, which is provided with small openings as shown in FIG. 3.

Figure 4:
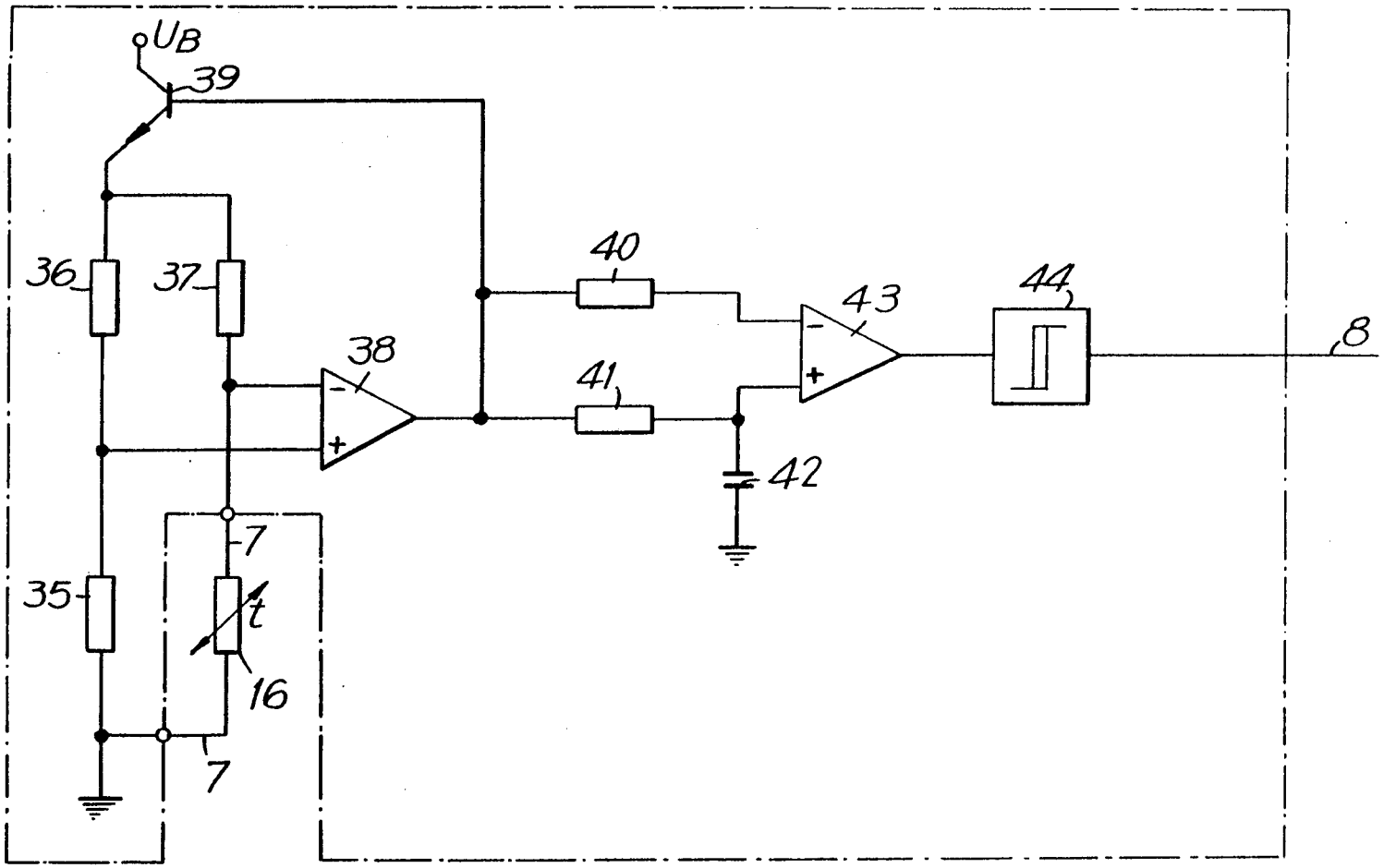
FIG. 4 is a circuit diagram of an analyzing circuit of the pneumatic controller of FIG. 2.

The analog signal conducting means 7 is connected to the hot wire 16. The flow sensor 1 is rigidly mounted in a T-shaped piece 14, which is located in the suction duct 29, which leads to the source of low pressure 30. The circuit diagram of the analyzing circuit is shown in FIG. 4. The hot wire 16 is connected electrically by the analog signal conducting means 7 with the inputs of the analyzing circuit 2. The flow sensor 1, the analyzing circuit 2 and the analog signal conducting means 7 together form an anemometer.

Together with the resistors 35, 36, 37 the hot wire 16 is connected in a bridge circuit in this analyzing circuit 2 as shown in FIG. 4, whose diagonal voltage is connected to the inputs of a first operational amplifier 38. The operational amplifier 38 operates as a difference amplifier. Its output controls the power transistor 39 and simultaneously a second operational amplifier 43, which likewise operates as a difference amplifier.

The negative input of the operational amplifier 43 is undelayed and the nonnegative input of the second operational amplifier 43 is delayed by the RC combination 41,42. The output of the operational amplifier 43 is processed by the threshold value circuit 44, to which is connected the output signal conductor 8.

The output signal conductor 8 is connected further with a first inputs of the and-gate circuit 18. The second input of the and-gate circuit 18 is connected to the pulse generator by an additional connecting line 9. The output of the and-gate 18 is a form of error signal, which contains the information regarding the presence or absence of a sheet.

The operation of the pneumatic controller according to the above is as follows:

On the first and second printing or working, the sheet 28 being printed in the press machine 21 is fed out from the tangent point of press cylinder 22 and sheet feed cylinder 25 and is gripped at its rear edge by the suction system 26. The sheet control occurs on action of the suction system 26 as follows:

The flow sensor 1 integrated in the suction duct 29 between the low pressure source 30 and the sheet feed cylinder 25, advantageously outside the body of the press machine 21, sends an electrical output signal to the analog signal conducting means 7, which is then processed by the analyzing circuit 2. The output signal from the analyzing circuit 2 is then transmitted to the first input of the masking circuit 3. For each rotation of a turning shaft (ETW) of the press machine, the rotation angle transmitter 5 and central pulse generator 4 generate a pulse and send it over the additional connecting line 9. The coupling of the rotation angle transmitter 5 and central pulse generator 4 is known and is described for example in German Patent DD-PS 228 700. The pulse is generated just before the end of the gripping of the sheet by the sheet feed cylinder 25—also at the end of the suction phase. Thus the pulse is correlated with the point in time during which there is little or no flow in the suction duct 29 of the source of low pressure 30 (assuming the sheets are running correctly through the press). However should a significant flow be present at the time of pulse generation, then the error signal is transmitted through the and-gate or masking circuit 3 and is fed to a control system 6 to command one of the press machine operating states.

When the sheets are not flowing correctly through the press and a sheet does not cover the suction duct, the low pressure produced by the source of low pressure 30 produces an air flow in the T-shaped piece 14 from A to B, which causes a cooling of the hot wire 16 of the flow sensor 1. Because of the heat conduction properties of the hot wire 16, there is a resistance change in the hot wire 16. The resistance of the hot wire 16 is proportional to its temperature and this depends in the first place on the size of the air volume flow rate. The resistance change is processed in the connected analyzing circuit 2. Conditions for the correct operation of this device are such that as a result of the electric current the temperature of the hot wire 16 is markedly above the temperature of the surroundings. With appropriate small dimensions of the hot wire 16, the time constant of the resistance change can be kept small. The bridge, comprising the hot wire 16 and the resistors 35, 36 and 37, is so tuned, that a very small diagonal voltage arises with the air flow not present(Normal sheet feed conditions). The output voltage of the operational amplifier 38, which controls the power transistor 39, is then at a comparatively low level. As soon as air flows over the hot wire 16 in sufficient quantity and thus cools it, the bridge is detuned so that an inverting input maintains a low potential like the noninverting input. Because of the high amplification factor of the operational amplifier 38 that has the consequence of an immediate drastic increase of its output voltage. The operating voltage of the bridge increases in the same proportion over the power transistor and thus electric current flows through it. The large current flow resulting causes a fresh electrical heating of the hot wire 16 until at the original temperature and thus is original resistance is restored. Thus the original condition of the detuned bridge are restored.

Because of this control circuit the output voltage of the bridge is proportional to the air volume flow rate in the flow sensor 1. The control circuit allows only a very slight temperature change of the hot wire 16, so that the temperature time constant drops considerably and the entire reaction time of the anemometer 1, 7 and 2 is very small, so that a reliable operation is guaranteed also at the highest machine speeds.

Because of the time constants of the RC members 41,42, a voltage at the noninverting input of the operational amplifier 42 is present, which represents the average volume flow. At the inverting input one finds the momentary value of the regulating voltage. In stationary operation both voltages are of similar size and the output voltage of the operational amplifier is nearly zero volts. With a sudden increase of the air flow in the flow sensor 1 because of a lost sheet 28 the potential increases simultaneously at the inverting input of operational amplifier 43, so that its output is controlled in the negative direction. This condition is dependent on the current pulse duration and on the time constant of the RC combination 41,42. This is corrected or adjusted to the theoretical maximum possible current duration. The negative output voltage at the operational amplifier 43 allows the threshold value circuit 44 to respond, so that the problem results in the generation of an output signal.

With the above described circuitry, a sliding operating point results for the operational amplifier 43, which has the advantage that there is an automatic fit to the fluctuations or variations (e.g. of the flow sensor 1) and in the operating conditions (e.g. rotation speed, press material).

The dual output signal supplied by the analyzing circuit 2 travels on the output conductor 8. The output signal passes through the and-gate 18 only when there is a signal simultaneously at both inputs of the and-gate 8. The pulse reaching the second input of the and-gate 18 thus masks the signal coming over the output conductor 8.

It will be understood that each of the elements described in the detailed description above, or two or more together, may also find a useful application in other types of constructions differing from the types described above.

While the invention has been illustrated and described as embodied in a pneumatic controller for a press machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. In a pneumatic controller in a press machine for detecting the presence or absence of one of a plurality of sheets fed through said press machine, the press machine having at least one turning shaft and containing a sheet feed cylinder on which said one of said sheets contacts during normal operation, the pneumatic controller comprising a suction system including a suction duct in the sheet feed cylinder and a source of low pressure connected to the suction duct, the suction duct opening onto a surface of the sheet feed cylinder on which said one of said sheets contacts at least partially obstructing an air flow through said suction duct during normal operation, the improvement comprising a flow sensor (1) having a hot wire (16) and a surrounding protective jacket (15), said flow sensor being located in said suction duct, and an analyzing circuit (2) connected to said flow sensor.

2. The improvement as defined in claim 1, wherein said flow sensor (1) and said analyzing circuit (2) are structured and connected to form an anemometer (1,2,7).

3. The improvement as defined in claim 1, wherein the flow sensor (1) is connected with the analyzing circuit (2) by an analog signal conducting means (7).

4. The improvement as defined in claim 1, wherein the analyzing circuit (2) contains an operational amplifier (43) and an RC combination (41,42) connected electrically to the operational amplifier (43) for automatic adjustment to different operating conditions.

5. The improvement as defined in claim 1, said hot wire and said surrounding protective jacket being structured, so that a portion of the flowing air in the suction duct contacts the hot wire, said analyzing circuit being structured to generate an output signal, when the flow of air in said suction duct increases.

6. The improvement as defined in claim 5, further comprising a rotation angle transmitter (5) having an output and being connected to the turning shaft, a central pulse generator (4) connected to the output of the rotation angle transmitter (5) and a masking circuit (3) having two inputs and an output, one of said inputs of said masking circuit being connected to receive the output signal from said analyzing circuit (2) and the other of said inputs of said masking circuit being structured to connected to said central pulse generator (4), said masking circuit producing an output signal for each rotation of said turning shaft, when said masking circuit simultaneously receives the output signal from said analyzing circuit and from said central pulse generator.

7. The improvement as defined in claim 6, wherein said analyzing circuit includes a bridge circuit having three resistors and the hot wire functioning as a fourth resistor, at least one amplifier circuit including an RC combination and at least one operational amplifier, said amplifier circuit being connected to the bridge circuit and a threshold value circuit connected to said amplifier circuit.

* * * * *